United States Patent [19]

Namiki

[11] 4,254,733

[45] Mar. 10, 1981

[54] FIXING DEVICE

[75] Inventor: Ryōichi Namiki, Hino, Japan

[73] Assignee: Ricoh Company, Ltd., Japan

[21] Appl. No.: 21,890

[22] Filed: Mar. 19, 1979

Related U.S. Application Data

[63] Continuation of Ser. No. 782,705, Jun. 17, 1977, abandoned.

[30] Foreign Application Priority Data

Apr. 12, 1976 [JP] Japan ..... 51-40268

[51] Int. Cl.[3] ..... B05C 11/00; G03G 15/20

[52] U.S. Cl. ..... 118/60

[58] Field of Search ..... 427/22; 118/60; 432/60, 432/228; 29/132; 219/216, 469

[56] References Cited

U.S. PATENT DOCUMENTS

| | | | |
|---|---|---|---|
| 3,810,776 | 5/1974 | Banks et al. | 427/94 |
| 3,844,252 | 10/1974 | Thettu | 118/60 |
| 3,921,573 | 11/1975 | Thettu | 118/60 |
| 3,937,919 | 2/1976 | Clerx et al. | 432/60 |
| 3,948,214 | 4/1976 | Thettu | 432/228 X |
| 3,989,005 | 11/1976 | Bowler et al. | 118/60 |
| 3,999,510 | 12/1976 | Thettu | 118/60 |
| 4,056,706 | 11/1977 | Strella | 432/228 X |

OTHER PUBLICATIONS

*Product Licensing Index*, Jul. 1972, pp. 72, 73.

*Primary Examiner*—Morris Kaplan
*Attorney, Agent, or Firm*—McGlew and Tuttle

[57] ABSTRACT

A device for fixing an image formed by electrostatic adhesion of toner particles on a copy sheet, wherein such copy sheet is passed between a pair of fixing rollers consisting of a fixing roller and a follower roller, the fixing roller having an offset preventing oil fed to its surface and being heated as required. The fixing roller and the follower roller each include a base material layer made of silicone rubber which is not caused to swell by the offset preventing oil and is swellable thereby. The fixing roller further include a thin surface layer formed on the outer surface of the base material layer and made of silicone rubber which has affinity with a silicone oil. The offset preventing oil may be a fluoroalkyl radical containing silicone oil or a mixture of such oil with an alkylpolysiloxane oil.

4 Claims, 2 Drawing Figures

FIXING DEVICE

This is a continuation of application Ser. No. 782,705 filed June 17, 1977, now abandoned.

BACKGROUND OF THE INVENTION

This invention relates to fixing device and more particularly to a fixing device for fixing an image formed by electrostatic adhesion of toner particles on a copy sheet by passing such copy sheet through a pair of fixing rollers.

An electrophotographic toner image fixing method which is capable of markedly lengthening the service life of a fixing roller has already been proposed by me in a Japanese Laid-Open Patent Application No. 185544/76. In accordance with this method, a chlorinated silicone oil, fatty acid modified silicone oil, nitrated silicone oil or fluorinated silicone oil may be used as an offset preventing oil, and methylpolysiloxane silicone rubber, vinylpolysilixane silicone rubber or phenylpolysiloxane silicone rubber may be used as a base material layer of the roller. Alternatively, any one of the aforesaid kinds of polysiloxane polymers used as an offset preventing silicone oil may be used as the base material layer of the roller, and any one of the aforesaid kinds of polysiloxane polymers used as the base material layer of the roller may be used as an offset preventing oil.

The method disclosed in this laid-open application has the objects of preventing damage to the roller which may be caused by its swelling due to contact with the oil and preventing the occurrence of an offset phenomenon when fixing of an image is effected. This method has a disadvantage in that the oil does not spread well on the surface of the roller and consequently fixing of an image cannot be effected satisfactorily, because of the fact that the kind of silicone polymer used as an offset preventing oil and the kind of silicone polymer used as the base material layer of the fixing roller are selected in such a manner that they have no affinity with each other so that no swelling of the base material layer of the roller may take place.

SUMMARY OF THE INVENTION

This invention has as its object the provision of a fixing device which is capable of effecting fixing of an image satisfactorily and lengthening the service life of fixing rollers.

The outstanding characteristic of the invention is that a fluoroalkyl radical containing polysiloxane silicone oil or a mixture of such oil and alkylpolysiloxane oil is used as an offset preventing oil, and the pair of fixing rollers consists of a fixing roller including a base material layer made of silicone rubber and having, an outer thin layer of a polymer which has an affinity for said oils and is caused to swell by contact therewith, and a follower roller including a base material layer which does not tend to be caused to swell by such oils.

Additional and other objects and advantages of the invention will become evident from the description of preferred embodiments of the invention set forth hereinafter.

DESCRIPTION OF THE PREFERRED EMBODIMENTS

When an offset preventing oil is used in performing fixing of a toner image on a copy sheet by passing such sheet through a pair of fixing rollers, the image is optimally maintained at a high temperature of about 200° C. during the fixing operation. Because of this, there arises the need that the pair of fixing rollers is made of a material which does not undergo material swelling, does not become sticky and does not show deterioration even if maintained in contact with an offset preventing oil over a prolonged period of time. Moreover, it is necessary that the offset preventing oil spreads well on the surface of the fixing roller, i.e. the surface of the fixing roller has affinity with the offset preventing oil. The fixing device according to the invention meets these requirements.

Figure 1:
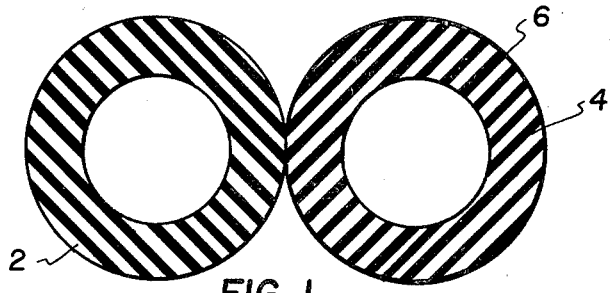
FIG. 1 is a sectional view of one embodiment of the invention.

In accordance with one device, a fluorine resin capable of withstanding elevated temperatures, such as a tetrafluoroethylene polymer or a copolymer of tetrafluoethylene and hexafluoropropylene, which has (at 200° C.) high oil resistance to and high affinity (the ability to form an oil film) with a fluoroalkyl radical containing silicone oil, is used for producing the base material layer of the fixing roller, and conventional alkylpolysiloxane silicone rubber, particularly dimethylpolysiloxane rubber, methylvinylpolysiloxane or methylpropylpolysiloxane rubber, which does not show swelling and does not permit formation of an oil film thereon in a satisfactory manner when brought into contact with the fluoroalkyl radical containing silicone oil is used for producing the base material layer of the follower roller. This embodiment is illustrated in FIG. 1. Fixing roller 4 is shown having a well distributed coating to offset preventing oil 6 thereon. The fixing roller is here made of the fluorine resin with an affinity for the oil, and the follower roller 12 is shown and made of the conventional silicone rubber with no swelling from or affinity for the oil.

In accordance with an illustrative embodiment of the device conforming to the present invention, the fixing roller comprises cylindrical metallic core having a heater in the interior, a conventional alkylpolysiloxane rubber layer formed on the cylindrical metallic core, and a thin layer formed on the rubber layer and made of fluoroalkyl radical containing polysiloxane rubber (e.g. Silastic 733 manufactured by Dow Corning Company) which tends to swell when brought into contact with the fluoroalkyl radical containing silicone oil and which has good affinity with such oil, or a phenyl radical containing alkylpolysiloxane rubber (e.g. SH955V manufactured by Toray Silicone Company) which slightly tends to swell when brought into contact with the aforesaid oil, and the follower roller comprises a cylindrical metallic core and a conventional alkylpolysiloxane rubber layer but does not contain a thin layer of swelling rubber. A silicone rubber showing a swelling tendency which is damaged by swelling remains undamaged when applied as a thin layer to the non-swelling silicone rubber layer. It is surprizing that a fixing roller constructed as aforesaid had a very long service life.

Figure 2:
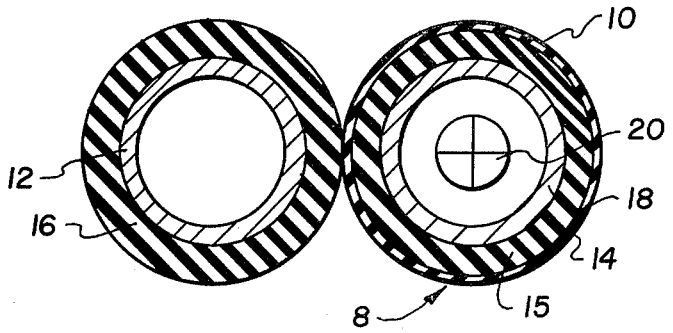
FIG. 2 is a sectional view of another embodiment of the invention.

This embodiment is illustrated in FIG. 2 wherein the metal core of the follower roller 12 is covered by rubber 16. Fixing roller 8 is made of metal core 18 with heater 20 therein. This core is covered with rubber 15 of the type used in the follower roller at 16, and has a thin layer of fluoralkyl radical containing polysiloxane rubber or other oil attracting rubber 14 over the base rubber layer which in turn has a coating of oil 10 thereon.

The conventional alkylpolysiloxane silicone rubber of non-swelling nature which is used as the base material layer of the fixing roller and the follower roller in accordance with the present invention is an excellent material for manufacturing a pair of fixing rollers because it is relatively low in cost and easy to work. Thus, a fixing roller comprising a base material layer made of the aforesaid material and a thin layer of the aforesaid high temperature resisting fluorine resin having affinity with an offset preventing oil can be used with advantage in the fixing device provided by the invention.

Of the fluoroalkyl radical containing silicone oils used for preventing the offset phenomenon in the invention, oils having a viscosity of about 50 to 1000 cS at normal temperature are preferred. Of these oils, an oil containing a fluoroprophy radical $CF_3\ CH_2\ CH_2$—(e.g. FS1265 manufactured by Dow Corning Company) best serves the purpose. This oil has a high lubricating quality, has a good thermal stability and is capable of forming a good oil film so as to achieve high offset preventing effect.

As an offset preventing oil, a mixture of a fluoroalkyl radical containing silicone oil and a conventional alkylpolysiloxane oil also can achieve good effect. The mixture is preferably of a composition such that the ratio of the volume of the alkylpolysiloxane oil in the mixture to the total volume of the mixture is less than 3%, preferably less than 25%.

To further illustrate this invention and not by way of limitation, the following examples are given.

EXAMPLE 1

Experiments were carried out by using a fluorinated silicone oil which was FS1265 (viscosity: 300cS) manufactured by Dow Corning Company as an offset preventing oil. The fixing roller used in the experiments comprised a cylindrical metallic core mounting an electric heater therein, and a tetrafluoroethylene layer (Teflon manufactured by Du Pont Company) formed on the cylindrical core. The follower roller comprised a cylindrical metallic core, and a dimethylpolysiloxane rubber layer. Fixing of toner images was carried out at a temperature of about 200° C. In spite of the fact that the rollers were used over a prolonged period of time, it has been found that the toner device can achieve excellent results in preventing the occurrence of the offset phenomenon and that the roller material shows no deterioration.

EXAMPLE 2

Experiments were carried out by using a fixing roller which comprised a base material layer made of methylvinylpolysiloxane rubber, and a thin layer formed on the base material layer and made of fluoroalkyl radical containing silicone rubber which was Silastic 733 manufactured by Dow Corning Company, and a follower roller which comprised only the aforesaid base material layer and had no thin layer formed thereon. The experiments were conducted as described with reference to Example 1 and the same excellent results were achieved.

EXAMPLE 3

Experiments were carried out by using a pair of fixing rollers each comprising a base material layer made of polysiloxane rubber, and at least one of such fixing rollers had a heater mounted in the interior. As an offset preventing oil, a mixture oil of 100 weight parts of Dow FS1265 (viscosity: 300cS) and 10 weight parts of KF96 or KF54 (viscosity: 10 to 1000cS) was used. The results of the experiments on fixing of toner images show that in this example excellent offset preventing effect and roller swelling preventing effect were achieved over a prolonged period of time.

What I claim is:

1. In a fixing device having a fixing roller engaged with a pressing roller for effecting fixing of toner images formed on copy sheets passed therebetween, with the fixing roller having a coating of offset preventing oil thereon, the improvement comprising:

the fixing roller including a base material layer made of a silicone rubber which is low in affinity for the oil and does not swell from contact with the oil, the roller having at its surface a thin layer of other rubber which has an affinity for said offset preventing oil, said thin layer of other rubber being caused to swell by contact with said offset preventing oil without leaving said base material layer and without causing said base material layer to swell;

the pressing roller made of a silicone rubber material which is low in affinity for the oil and does not swell from contact with the oil;

means feeding said oil to the fixing roll;

the offset preventing oil chosen from the group consisting of fluoroalkyl radical containing polysiloxane oil and a mixture of fluoroalkyl radical containing polysiloxane oil and an alkyl polysiloxane oil;

whereby the offset preventing oil sufficiently wets said thin surface layer of other rubber of said fixing roller to form a uniform and consistent film of offset preventing oil thereon.

2. The improvement of claim 1, wherein said silicone rubber of said base material layer of said fixing roller consists of alkylpolysiloxane silicone rubber.

3. The improvement of claim 1, wherein said silicone rubber material of said pressing roller is chosen from the group consisting of alkylpolysiloxane rubber, dimethylpolysiloxane rubber, methylvinylpolysiloxane rubber and methylpropylpolysiloxane rubber.

4. In a fixing device having a fixing roller engaged with a pressing roller for effecting fixing of toner images formed on copy sheets passed therebetween, with the fixing roller having a coating of offset preventing oil thereon, the improvement comprising:

the fixing roller including a base material layer made of a silicone rubber which is low in affinity for the oil and does not swell from contact with the oil, the roller having at its surface a thin layer of other rubber which has an affinity for said offset preventing oil, said thin layer of other rubber being caused to swell by contact with said offset preventing oil without leaving said base material layer and without causing said base material layer to swell;

the pressing roller made of a silicone rubber material which is low in affinity for the oil and does not swell from contact with the oil;

means feeding said oil to the fixing roll;

the offset preventing oil chosen from the group consisting of a fluoroalkyl radical containing polysiloxane oil and a mixture of fluoroalkyl radical containing polysiloxane oil and an alkyl polysiloxane oil;

whereby the offset preventing oil sufficiently wets said thin surface layer of other rubber of said fixing roller to form a uniform and consistent film of offset preventing oil thereon;

said other rubber forming said thin surface layer of said fixing roller chosen from the group consisting of tetrafluoroethylene polymer, and a copolymer of tetrafluoroethylene and hexafluoropropylene.

* * * * *